US011643900B2

(12) United States Patent
Hrupp

(10) Patent No.: US 11,643,900 B2
(45) Date of Patent: May 9, 2023

(54) MODULAR PRESSURE CYLINDER FOR A DOWNHOLE TOOL

(71) Applicant: EXACTA-FRAC ENERGY SERVICES, INC., Conroe, TX (US)

(72) Inventor: Joze John Hrupp, Montgomery, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 0 days.

(21) Appl. No.: 17/192,215

(22) Filed: Mar. 4, 2021

(65) Prior Publication Data

US 2021/0189831 A1 Jun. 24, 2021

Related U.S. Application Data

(63) Continuation of application No. 15/961,953, filed on Apr. 25, 2018, now Pat. No. 10,982,503.

(60) Provisional application No. 62/608,707, filed on Dec. 21, 2017.

(51) Int. Cl.

| | |
|---|---|
| ***E21B 33/12*** | (2006.01) |
| ***E21B 33/124*** | (2006.01) |
| ***E21B 34/10*** | (2006.01) |
| ***E21B 33/122*** | (2006.01) |
| *E21B 33/129* | (2006.01) |

(52) U.S. Cl.

CPC ..... *E21B 33/1246* (2013.01); *E21B 33/122* (2013.01); *E21B 33/124* (2013.01); *E21B 34/10* (2013.01); *E21B 33/1294* (2013.01)

(58) Field of Classification Search

CPC .. E21B 33/122; E21B 33/124; E21B 33/1246; E21B 33/1294; E21B 34/10

See application file for complete search history.

(56) References Cited

U.S. PATENT DOCUMENTS

| | | | |
|---|---|---|---|
| 2,769,497 | A | 11/1956 | Reistle, Jr. |
| 2,927,638 | A | 3/1960 | Hall, Sr. |
| 3,090,436 | A | 5/1963 | Briggs, Jr. |
| 3,160,209 | A | 12/1964 | Bonner |
| 4,487,258 | A | 12/1984 | Jackson et al. |
| 4,519,456 | A | 5/1985 | Cochran |
| 5,152,340 | A | 10/1992 | Clark et al. |
| 5,383,520 | A | 1/1995 | Tucker et al. |
| 5,803,177 | A | 9/1998 | Hriscu et al. |
| 5,810,082 | A | 9/1998 | Jordan et al. |
| 5,890,540 | A | 4/1999 | Pia et al. |
| 5,904,207 | A | 5/1999 | Rubbio et al. |
| 6,253,856 | B1 | 7/2001 | Ingram et al. |
| 6,484,805 | B1 | 11/2002 | Perkins et al. |
| 6,564,876 | B2 | 5/2003 | Vaynshteyn |
| 6,776,239 | B2 | 8/2004 | Elsinger et al. |
| 6,832,654 | B2 | 12/2004 | Ravensburger et al. |
| 7,341,111 | B2 | 3/2008 | Van et al. |

(Continued)

*Primary Examiner* — Cathleen R Hutchins
*Assistant Examiner* — Ronald R Runyan
(74) *Attorney, Agent, or Firm* — JK Intellectual Property Law, PA

(57) ABSTRACT

A modular pressure cylinder for a downhole tool has an active mandrel tube that supports a modular pressure cylinder. Pistons of the modular pressure cylinder are respectively interconnected and cylinder walls of modular pressure cylinder are respectively interconnected. When fluid is pumped through a tubing string into the downhole tool, the pistons are urged in one direction while the cylinder walls are urged in an opposite direction along an axis of the active mandrel tube.

9 Claims, 5 Drawing Sheets

(56) References Cited

U.S. PATENT DOCUMENTS

| | | | |
|---|---|---|---|
| 7,377,834 | B2 | 3/2008 | Surjaatmadja et al. |
| 7,500,526 | B2 | 3/2009 | Telfer |
| 7,789,163 | B2 | 9/2010 | Kratochvil et al. |
| 8,201,631 | B2 | 6/2012 | Stromquist et al. |
| 8,336,615 | B2 | 12/2012 | Hughes et al. |
| 8,490,702 | B2 | 7/2013 | Stromquist et al. |
| 9,016,390 | B2 | 4/2015 | Stewart et al. |
| 9,334,714 | B2 | 5/2016 | Stromquist et al. |
| 9,580,990 | B2 | 2/2017 | Flores et al. |
| 9,598,939 | B2 | 3/2017 | Lee |
| 2005/0077053 | A1 | 4/2005 | Walker et al. |
| 2007/0034370 | A1 | 2/2007 | Moyes |
| 2014/0182862 | A1 | 7/2014 | Derby |
| 2015/0376979 | A1 | 12/2015 | Mitchell et al. |
| 2016/0369585 | A1 | 12/2016 | Limb et al. |

MODULAR PRESSURE CYLINDER FOR A DOWNHOLE TOOL

CROSS REFERENCE TO RELATED APPLICATIONS

Applicant claims the benefit to priority under 35 U.S.C. § 119(e) of provisional patent application 62/608,707 filed on Dec. 21, 2017.

FIELD OF THE INVENTION

This invention relates in general to piston assemblies for converting pumped fluid pressure to mechanical force in a downhole tool and, in particular, to a novel modular pressure cylinder for converting pumped fluid pressure to mechanical force in a downhole tool.

BACKGROUND OF THE INVENTION

Piston assemblies for converting pumped fluid pressure to mechanical force in a downhole tool are known and used in downhole tools such as packers, straddle packers, tubing perforators and the like. Such piston assemblies use a plurality of pistons connected to an inner or outer mandrel of a downhole tool to increase the force that can be generated from a given pressure of fluid pumped down a tubing string to the downhole tool. An example of one such piston assembly can be found in U.S. Pat. No. 8,336,615 which issued on Dec. 25, 2012. While these piston assemblies have proven useful, they suffer certain limitations that affect their utility. For example, if mechanical force is required at opposite ends of a downhole tool, a piston assembly must be provided on each end of the downhole tool, as taught for example in U.S. Pat. No. 9,598,939 which issued on Mar. 21, 2017. This increases a length of the down hole tool, which can be undesirable.

There therefore exists a need for a modular pressure cylinder for a downhole tool that overcomes the shortcomings of known prior art prior art piston assemblies.

SUMMARY OF THE INVENTION

It is therefore an object of the invention to provide a modular pressure cylinder for a downhole tool.

The invention therefore provides a modular pressure cylinder for a downhole tool, comprising: an active mandrel tube having a central passage and active mandrel tube fluid ports in fluid communication with the central passage; and a modular pressure cylinder that reciprocates on the active mandrel tube, the modular pressure cylinder including at least two interconnected pressure cylinder modules having interconnected pressure cylinder walls and interconnected pressure pistons that reciprocate within pressure cylinders, the interconnected pressure pistons including pressure cylinder fluid ports that permit fluid flowing through the active mandrel tube fluid ports to enter the pressure cylinders and simultaneously urge the interconnected pressure cylinder walls and the interconnected pressure pistons to move in opposite directions along an axis of the active mandrel tube.

The invention further provides a modular pressure cylinder for a downhole tool, comprising: an active mandrel tube having a central passage and active mandrel tube fluid ports that provide fluid communication between the central passage and an external periphery of the active mandrel tube; and a modular pressure cylinder that reciprocates on the active mandrel tube, the modular pressure cylinder including at least two interconnected pressure cylinder modules having interconnected pressure cylinder walls and pressure pistons respectively having pressure cylinder male coupling sleeves and pressure cylinder female coupling sleeves that interconnect the pressure pistons, the pressure pistons reciprocating within pressure cylinders defined by the interconnected pressure cylinder walls and the interconnected pressure cylinder male and female coupling sleeves, the interconnected pressure cylinder male and female coupling sleeves including pressure cylinder fluid ports that permit pressurized fluid flowing through the active mandrel tube fluid ports to flow into the pressure cylinders and urge the interconnected pressure cylinder walls and the interconnected pressure pistons to move in opposite directions along an axis of the active mandrel tube.

The invention yet further provides a modular pressure cylinder for a downhole tool, comprising: an active mandrel tube having a central passage and active mandrel tube fluid ports that provide fluid communication between the central passage and an external periphery of the active mandrel tube with active mandrel tube axial grooves in an outer periphery thereof, the active mandrel tube axial grooves respectively being in fluid communication with the active mandrel tube fluid ports to ensure fluid communication between the central passage and respective pressure cylinder fluid ports of the modular pressure cylinder while the modular pressure cylinder is urged along an axis of the active mandrel tube; and a modular pressure cylinder that reciprocates on the active mandrel tube, the modular pressure cylinder including at least two interconnected pressure cylinder modules having interconnected pressure cylinder walls and pressure pistons respectively having pressure cylinder male coupling sleeves and pressure cylinder female coupling sleeves that interconnect the pressure pistons, the pressure pistons having pressure piston seals that respectively provide a fluid seal against the respective pressure cylinder walls, the pressure pistons reciprocating within pressure cylinders defined by the interconnected pressure cylinder walls and the interconnected pressure cylinder male and female coupling sleeves, the interconnected pressure cylinder male and female coupling sleeves including pressure cylinder fluid ports that permit pressurized fluid flowing through the active mandrel tube to flow into the pressure cylinders and urge the interconnected pressure cylinder walls and the interconnected pressure pistons to move in opposite directions along an axis of the active mandrel tube, and the pressure cylinder walls respectively including pressure cylinder pressure equalization ports to equalize fluid pressure behind the respective pressure pistons.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
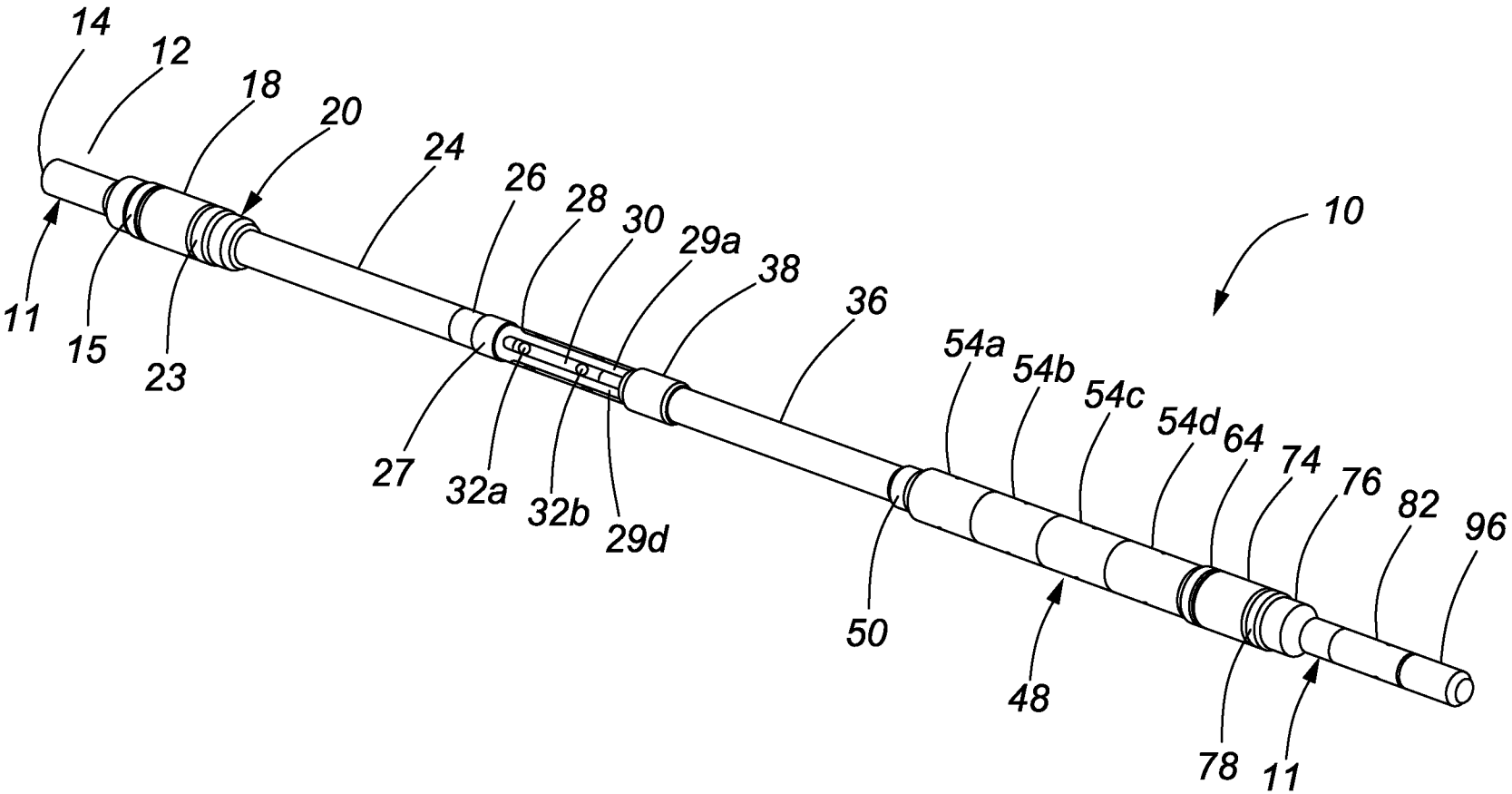
FIG. 1 is a perspective view of an embodiment of a straddle packer with fluid pressure packer set in accordance with the invention in a run-in condition.

The invention provides a modular pressure cylinder for a downhole tool. The pressure cylinder has an active mandrel tube with a central passage and active mandrel tube fluid ports in fluid communication with the central passage, and a modular pressure cylinder that reciprocates on the active mandrel tube. The modular pressure cylinder includes at least two interconnected pressure cylinder modules having interconnected pressure cylinder walls and interconnected pressure pistons that reciprocate within pressure cylinders. The interconnected pressure pistons include pressure cylinder fluid ports that permit fluid flowing through the active mandrel tube fluid ports to enter the pressure cylinders and simultaneously urge the interconnected pressure cylinder walls and the interconnected pressure pistons to move in opposite directions along an axis of the active mandrel tube.

| Part No. | Part Description |
|---|---|
| 10 | Straddle packer |
| 11 | Multicomponent mandrel |
| 12 | Completion string connection component |
| 13 | Multicomponent mandrel central passage |
| 14 | Completion string connection |
| 15 | Upper packer element compression shoulder |
| 16 | Upper packer element sleeve |
| 18 | Upper packer element |
| 20 | Upper compression bell |
| 21a, 21b | Upper compression bell pressure equalization ports |
| 22 | Upper mandrel tube |
| 23 | Upper compression bell shoulder |
| 24 | Upper sliding sleeve |
| 25 | Upper sliding sleeve threaded connection |
| 26 | Upper sliding sleeve coupling |
| 27 | Slotted sliding sleeve female coupling end |
| 28 | Slotted sliding sleeve |
| 29a, 29b | Sliding sleeve finger components |
| 30 | Mandrel flow sub |
| 31 | Mandrel flow sub grooves |
| 32a-32h | Mandrel flow sub nozzles |
| 33 | Slotted sliding sleeve captured end thread |
| 33a | Slotted sliding sleeve coupling thread |
| 34 | Lower sliding sleeve coupling |
| 34a | Lower sliding sleeve coupling upper thread |
| 34b | Lower sliding sleeve coupling lower thread |
| 36 | Lower sliding sleeve |
| 37 | Lower sliding sleeve threaded connection |
| 38 | Slotted sliding sleeve captured end coupling ring |
| 40a, 40b | Cap screws |
| 42 | Lower mandrel tube |
| 44 | Mandrel tube crossover component |
| 46 | Active mandrel tube component |
| 48 | Modular pressure cylinder |
| 49a-49h | Active mandrel tube fluid ports |
| 50 | Sleeve/cylinder crossover |

-continued

| Part No. | Part Description |
|---|---|
| 52a-52j | Pressure cylinder pressure equalization ports |
| 53a-53d | Active mandrel tube axial grooves |
| 54a-54d | Pressure cylinder modules |
| 55a-55d | Pressure cylinder walls |
| 56a-56d | Pressure pistons |
| 57a-57h | Pressure cylinder fluid ports |
| 58a-58d | Pressure cylinder male coupling sleeves |
| 59a-59b | Pressure cylinder chambers |
| 60a-60d | Pressure cylinder female coupling sleeves |
| 62 | Pressure cylinder crossover sleeve |
| 64 | Lower compression bell |
| 65a, 65b | Lower compression bell equalization ports |
| 66a-66d | Pressure piston seals |
| 66j | Compression bell seal |
| 67a-67d | Pressure cylinder seals |
| 68a-68e | Pressure cylinder coupling seals |
| 69 | Pressure cylinder crossover sleeve seal |
| 70 | Lower compression bell male coupling sleeve |
| 72 | Lower packer element mandrel sleeve component |
| 74 | Lower packer element |
| 76 | Lower crossover sub |
| 78 | Lower packer element compression shoulder |
| 80 | Lower crossover sub male connector |
| 82 | Velocity bypass sub |
| 83 | Velocity bypass sub threaded downhole end |
| 84 | Velocity bypass valve |
| 85a | Velocity bypass sub connector end |
| 85b | Velocity bypass sub valve end |
| 86 | High pressure fluid seal |
| 88a-88b | Velocity bypass valve ports |
| 90 | Velocity bypass valve spring |
| 92 | Velocity bypass valve jet nozzle |
| 94a, 94b | Cap screws |
| 96 | Lower end cap |

FIG. 1 is a perspective view of one embodiment of the straddle packer 10 with fluid pressure packer set in accordance with the invention in the run-in condition. The straddle packer 10 has a multicomponent mandrel 11, the majority of which can only be seen in a cross-sectional view (see FIG. 2). The multicomponent mandrel 11 extends from the uphole end to the downhole end of the straddle packer 10. On the uphole end of the multicomponent mandrel 11, a completion string connection component 12 includes a completion string connection 14 (best seen in FIGS. 2 and 4). A configuration of the completion string connection 14 is a matter of design choice and dependent on whether the straddle packer 10 is to be operated using a coil tubing string (not shown) or jointed tubing string (not shown), as is well understood in the art.

The completion string connection component 12 has an upper packer element compression shoulder 15 and an upper packer element sleeve 16 (see FIGS. 2 and 4) that supports an elastomeric upper packer element 18, the function of which will be explained below with reference to FIG. 4. On a downhole side of the upper packer element 18 is an upper compression bell 20 having an upper compression bell shoulder 23 for compressing the upper packer element 18. The upper compression bell 20 slides over the upper element packer sleeve 16, as will be explained below with reference to FIG. 4. An upper sliding sleeve 24 is connected to a downhole side of the upper compression bell 20. The upper sliding sleeve 24 is connected to an upper sliding sleeve coupling 26, which is in turn connected to a female coupling end 27 of a slotted sliding sleeve 28. In one embodiment, the slotted sliding sleeve 28 has four slotted sliding sleeve finger components 29*a*-29*d*, two of which, 29*a*, 29*d*, can be seen in this view. The slotted sliding sleeve finger components 29*a*-29*d* define four slots that respectively expose at least one mandrel flow sub nozzle of a mandrel flow sub 30. In this embodiment, the mandrel flow sub 30 has a plurality of mandrel flow sub nozzles, 32*a*-32*h* (only 32*a* and 32*b* are visible in this view—better seen in FIGS. 3*a* and 3*b*). It should be understood the number of mandrel flow sub nozzles is a matter of design choice. It should also be understood that a size and shape of the at least one mandrel flow sub nozzle is a matter of design choice and that it may be permanent or interchangeable and any one of, but not limited to, a bore and a slot or any combination thereof. A downhole end of the sliding sleeve finger components 29*a*-29*d* are threadedly connected to a slotted sliding sleeve captured end coupling ring 38 that surrounds a lower sliding sleeve coupling 34 (see FIG. 2) that is threadedly connected to a lower sliding sleeve 36. A downhole end of the lower sliding sleeve 36 is connected to a sleeve/cylinder crossover 50 that is in turn connected to a modular pressure cylinder 48 assembled by interconnecting a plurality of pressure cylinder modules, 54*a*-54*d* in this embodiment. The pressure cylinder module 54*d* is connected to a lower compression bell 64 that slides over a lower packer element mandrel sleeve component 72 (see FIGS. 2 and 4) of the multicomponent mandrel 11, which supports an elastomeric lower packer element 74. Connected to the lower packer element mandrel sleeve component 72 is a lower crossover sub 76 having a lower packer element compression shoulder 78. In one embodiment a velocity bypass sub 82, which will be explained below with reference to FIGS. 5*a* and 5*b*, is connected to a downhole side of the lower crossover sub 76. A lower end cap 96, which caps the downhole end of the multicomponent mandrel 11, is connected to the lower crossover sub 76 or the velocity bypass sub 82 when the velocity bypass sub 82 is incorporated into the straddle packer 10.

Figure 2:
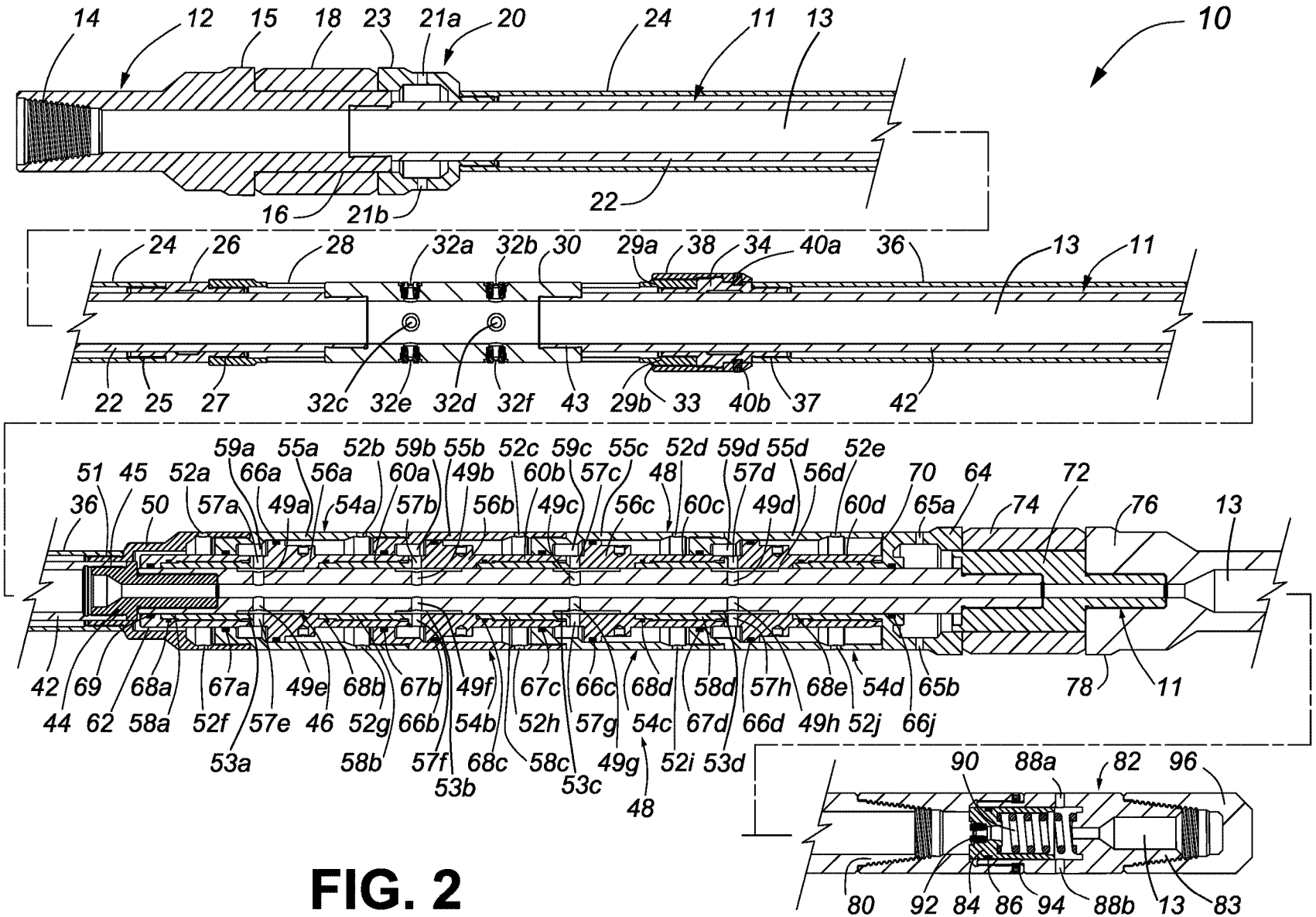
FIG. 2 is a cross-sectional view of the straddle packer shown in FIG. 1, in the run-in condition.

FIG. 2 is a cross-sectional view of the straddle packer 10 shown in FIG. 1 in the run-in condition, in which the upper packer element 18 and lower packer element 74 are in a relaxed, unset condition suitable for moving the straddle packer 10 to a desired location in a wellbore. As explained above, the slotted sliding sleeve 28 is connected to the lower sliding sleeve 36 by the lower sliding sleeve coupling 34, which is threadedly connected to both the slotted sliding sleeve 28 and the lower sliding sleeve 36, The slotted sliding sleeve captured end coupling ring 38 that covers the lower sliding sleeve coupling is likewise threadedly connected to the slotted sliding sleeve 28. Rotation of the slotted sliding sleeve captured end coupling ring 38 is inhibited by cap screws 40*a*, 40*b*.

As explained above, the elastomeric upper packer element 18 is supported on the upper packer element sleeve 16 of the completion string connection component 12 of the multicomponent mandrel 11. The multicomponent mandrel 11 has a central passage 13 that provides an uninterrupted fluid path through the multicomponent mandrel 11. The multicomponent mandrel 11 includes the following interconnected components: the completion string connection component 12, which is threadedly connected to an upper mandrel tube 22; the mandrel flow sub 30 connected to a downhole end of upper mandrel tube 22; the wear-resistant, replaceable mandrel flow sub nozzle(s), in this embodiment 32*a*-32*h* (only 6 of which, 32*a*-32*b*, 32*c*-32*d* and 32*e*-32*f*, are visible in this view); a lower mandrel tube 42 connected to a downhole end of the mandrel flow sub 30; a mandrel tube crossover component 44 connected to a downhole end of the lower mandrel tube 42; an active mandrel tube component 46 that supports the modular pressure cylinder 48 is connected to a downhole end of the mandrel tube crossover component 44; the lower packer element mandrel sleeve component 72 connected to a downhole end of the active mandrel tube component 46; the lower crossover sub 76 connected to the downhole end of the lower packer element mandrel sleeve component 72; and the optional velocity bypass sub 82 connected to a lower crossover sub male connector 80 of the lower crossover sub 76.

In one embodiment the velocity bypass sub 82 has a threaded downhole end 83 to permit the connection of another downhole tool or, in this embodiment, a lower end cap 96 that caps the central passage 13 of the multicomponent mandrel 11 and prevents debris from entering the velocity bypass sub 82 and the central passage 13 if the straddle packer 10 is run into a downhole proppant plug, or other debris in a wellbore. In an alternate embodiment the lower end cap 96 is connected directly to the lower crossover sub 76.

The active mandrel tube component 46 slidably supports the respective pressure cylinder modules 54*a*-54*d* of the modular pressure cylinder 48. As explained above, the number of pressure cylinder modules used in the straddle packer 10 is a matter of design choice, but four modules has been found to be appropriate for many applications. If the number of pressure cylinder modules is changed, a length of the active mandrel tube component 46 is modified accordingly, as will be readily understood by those skilled in the art. In this embodiment, the active mandrel tube component 46 has two active mandrel tube fluid ports (collectively 49*a*-49*h*) that provide fluid communication between the central passage 13 and each of the respective pressure cylinder modules 54*a*-54*d*. Active mandrel tube axial grooves 53*a*-53*d* respectively ensure fluid communication with the respective pressure cylinder modules Ma-54*d* regardless of a relative rotation of the active mandrel tube component 46 with respect to the modular pressure cylinder 48. The active mandrel tube axial grooves 53*a*-53*d* also ensure fluid communication between the central passage 13 and the respective pressure cylinder modules 54*a*-54*d* when the straddle packer 10 is shifted from the run-in condition the to set condition shown in FIG. 4.

In this embodiment, each of the pressure cylinder modules 54*a*-54*d* are identical and each pressure cylinder module 54*a*-54*d* respectively includes the following components: a pressure cylinder wall 55*a*-55*d*; a pressure piston 56*a*-56*d* with respective pressure piston seals 66*a*-66*d* that respectively seal against an inner surface of the respective pressure cylinder walls 55*a*-55*d*; each pressure piston 56*a*-56*d* reciprocates within a pressure cylinder chamber 59*a*-59*d*; pressure cylinder seals 67*a*-67*d* respectively inhibit the migration of fluid out of the respective pressure cylinder chambers 59*a*-59*d*; each pressure piston 56*a*-56*d* has a pressure cylinder male coupling sleeve 58*a*-58*d* and a pressure cylinder female coupling sleeve 60*a*-60*d*; in one embodiment the respective pressure cylinder male coupling sleeves 58*b*-58*d* may have an external thread that engages an internal thread in the respective pressure cylinder female coupling sleeves 60*a*-60*c* to connect the respective pressure pistons 56*a*-56*d* together, in another embodiment the respective cylinder modules 54*a*-54*d* are overlapped as shown but not threadedly connected and held together by compression between the upper packer element 18 and the lower packer element 74; respective pressure cylinder coupling seals 68*b*-68*d* inhibit any migration of fluid between the pressure cylinder male coupling sleeves 58*b*-58*d* and the pressure cylinder female coupling sleeves 60*a*-60*c*; pressure cylinder fluid ports 57*a*-57*h* let the high pressure fluid flow through active mandrel tube fluid ports 49*a*-49*h* into the respective pressure cylinder chambers 59*a*-59*d*; pressure cylinder pressure equalization ports 52*a*-52*j* in the respective cylinder walls 55*a*-55*d* equalize pressure behind the respective pressure pistons 56*a*-56*d* with ambient wellbore pressure. In one embodiment the active mandrel tube fluid ports 49*a*-49*h* and the pressure cylinder pressure equalization ports 52*a*-52*j* are provided with high pressure fluid filters (for example, sintered metal filters that known in the art (not shown)) that permit fluid to pass through the respective active mandrel tube fluid ports 49*a*-49*h* and pressure cylinder pressure equalization ports 52*a*-52*j* but inhibit particulate matter from migrating into the respective pressure cylinder chambers 59*a*-59*d*.

A pressure cylinder crossover sleeve 62 caps the pressure cylinder male coupling sleeve 58*a* of the pressure cylinder module 54*a*. A pressure cylinder crossover sleeve seal 69 provides a fluid seal between the pressure cylinder crossover sleeve 62 and the active mandrel tube component 46, and a pressure cylinder coupling seal 68*a* provides a fluid seal between the pressure cylinder crossover sleeve 62 and the pressure cylinder male coupling sleeve 58*a*. The pressure cylinder female coupling sleeve 60*d* is threadedly connected to a lower compression bell male coupling sleeve 70. A pressure cylinder coupling seal 68*e* provides a high pressure fluid seal between the pressure cylinder female coupling sleeve 60*d* and the lower compression bell male coupling sleeve 70. A compression bell seal 66*j* prevents the migration of fluid between the lower compression bell male coupling sleeve 70 and the active mandrel tube component 46.

When high pressure fluid is pumped into the straddle packer 10, the modular pressure cylinder 48 compresses the upper packer element 18 and the lower packer element 74 to isolate a section of the wellbore between the two packer elements 18, 74 after a pumped fluid rate exceeds a flow rate of the flow sub nozzle(s) 32*a*-32*h*. If the optional velocity bypass sub 82 is present, the modular pressure cylinder 48 compresses the upper packer element 18 and the lower packer element 74 to isolate a section of the wellbore between the two packer elements 18, 74 after the velocity bypass valve closes, as will be explained below in detail with reference to FIG. 4.

Figure 3A:
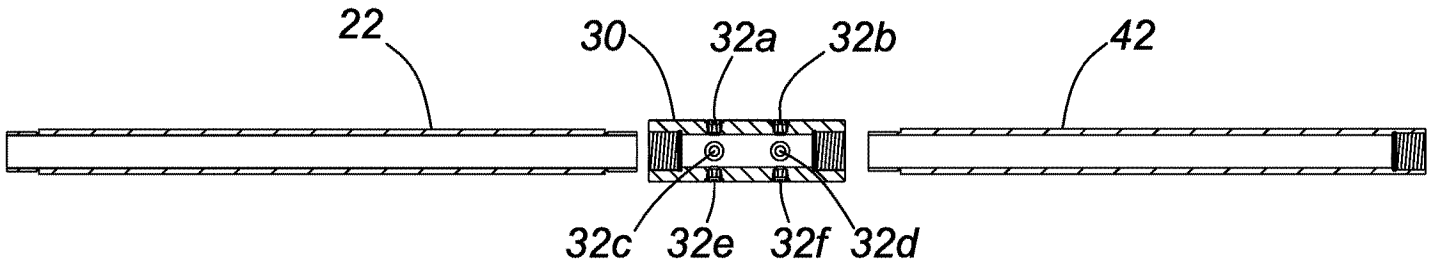
FIG. 3*a* is an exploded cross-sectional view of mandrel tubes and mandrel flow sub of the straddle packer shown in FIG. 2.

FIG. 3*a* is an exploded cross-sectional view of mandrel tubes 22, 42 and mandrel flow sub 30 of the straddle packer 10 shown in FIG. 2. As explained above, the upper mandrel tube 22 is threadedly connected to the mandrel flow sub 30. In this embodiment, the mandrel flow sub 30 has eight replaceable mandrel flow sub nozzles 32*a*-32*h*, though the number of mandrel flow sub nozzles is a matter of design choice. The lower mandrel tube 42 is threadedly connected to the downhole side of the mandrel flow sub 30.

Figure 3B:
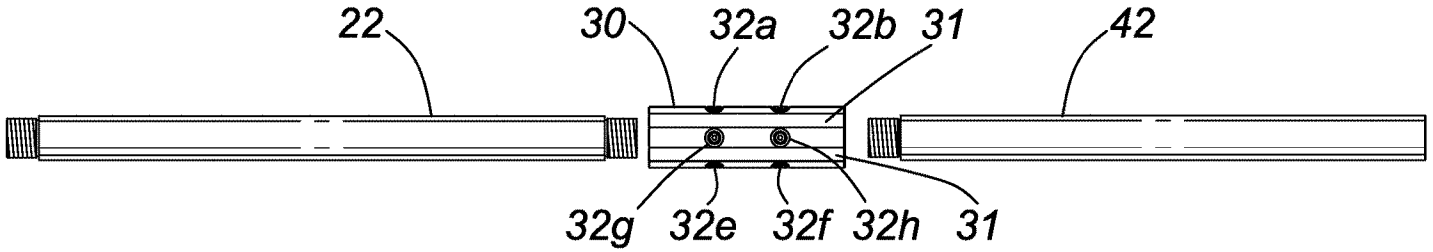
FIG. 3*b* is an exploded side elevational view of the mandrel tubes and the mandrel flow sub shown in FIG. 3*a;*

FIG. 3*b* is an exploded side elevational view of the mandrel tubes 22, 42 and the mandrel flow sub 30 shown in FIG. 3*a*. In this embodiment, the mandrel flow sub 30 is generally cylindrical but has four spaced apart axial mandrel flow sub grooves 31 in a top surface thereof that respectively receive one of the slotted sliding sleeve finger components 29*a*-29*d* (see FIG. 3*c*). When the slotted sliding sleeve 28 is slid over the mandrel flow sub 30, a top surface of the sliding sleeve finger components is flush with outer surfaces of the mandrel flow sub 30, as can be seen in FIGS. 2 and 4.

Figure 3C:
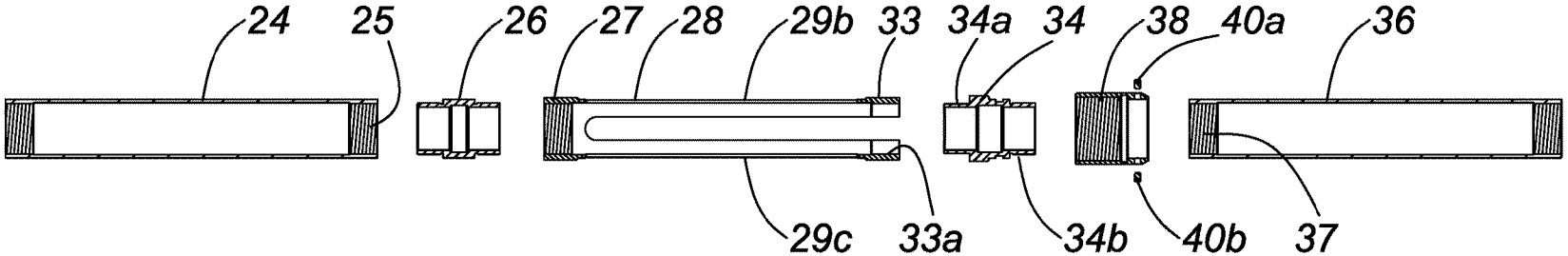
FIG. 3*c* is an exploded cross-sectional view of sliding sleeves that reciprocate, from the run-in condition to the packer set condition, on the mandrel tubes of the straddle packer shown in FIG. 3*b;*

FIG. 3*c* is an exploded cross-sectional view of sliding sleeves 24, 28, 36 that reciprocate, from the run-in condition to the upper packer set condition and back to the run-in condition, on the upper mandrel tube 22, the mandrel flow sub 30 and the lower mandrel tube 42 shown in FIG. 3*b*. The upper sliding sleeve 24 slides over the upper mandrel tube 22. As explained above, the upper sliding sleeve 24 is threadedly connected by upper sliding sleeve thread connection 25 to the upper sliding sleeve coupling 26. The upper sliding sleeve coupling 26 is in turn threadedly connected to the slotted sliding sleeve female coupling end 27 of the slotted sliding sleeve 28. The slotted sliding sleeve finger components 29*a*-29*d* (only 29*b* and 29*c* are visible in this view) are threadedly connected by a slotted sleeve coupling thread 33*a* to a lower sliding sleeve coupling upper thread 34*a*. The lower sliding sleeve 36 is threadedly connected to the lower sliding sleeve coupling 34 by a lower sliding sleeve coupling lower thread 34*b* that engages a lower sliding sleeve threaded connection 37. As explained above, the slotted sliding sleeve captured end coupling ring 38 covers the lower sliding sleeve coupling 34 and threadedly engages the slotted sliding sleeve captured end thread 33. After the slotted sliding sleeve captured end coupling ring 38 is fully threaded onto the slotted sleeve captured end thread 33 of the slotted sliding sleeve 28, the cap screws 40*a*, 40*b* are tightened to inhibit rotational movement.

Figure 4:
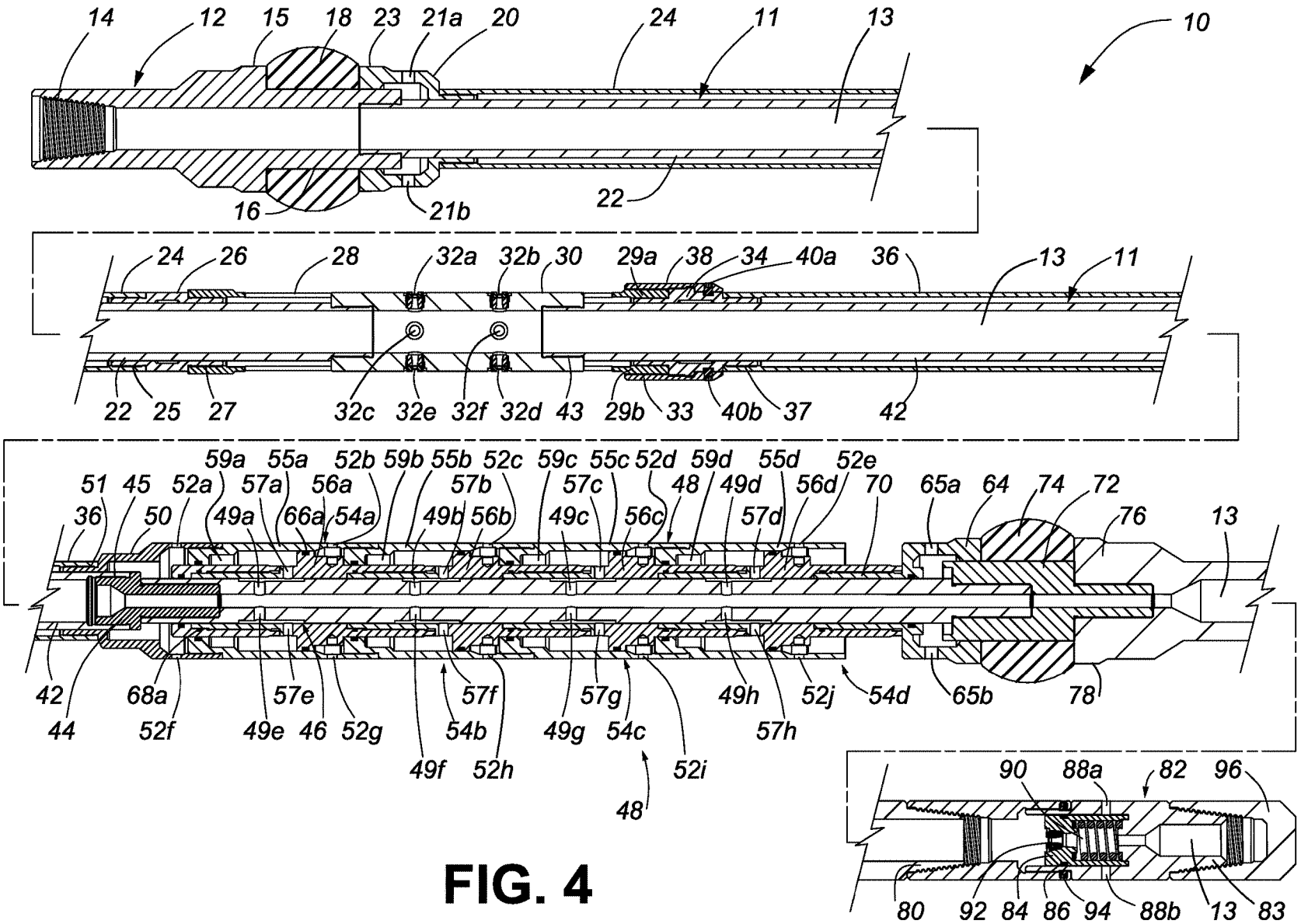
FIG. 4 is a cross-sectional view of the embodiment of the straddle packer shown in FIG. 1 in the packer set condition.
Figure 5A:
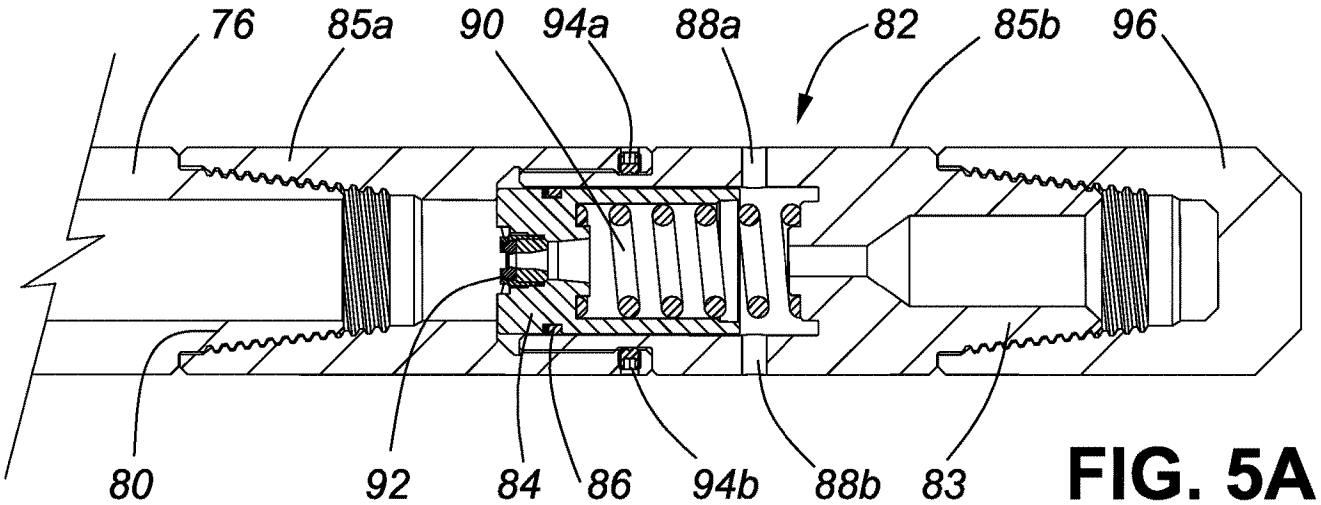
FIG. 5*a* is a cross-sectional view of a velocity bypass sub of the straddle packer shown in FIGS. 1, 2 and 4, with a velocity bypass valve of the velocity bypass sub in an open condition.
Figure 5B:
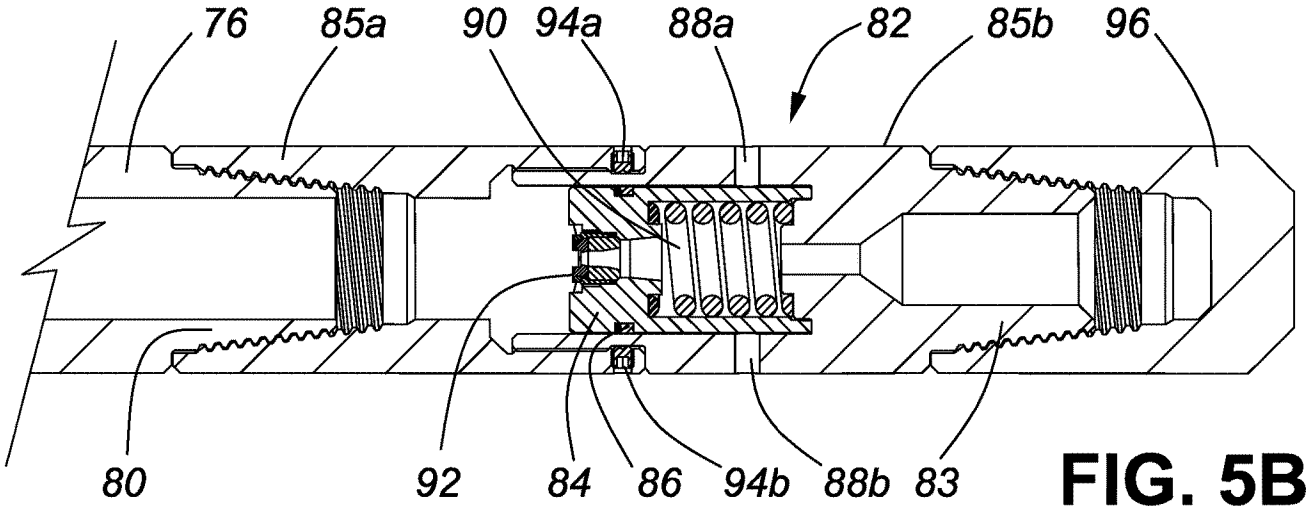
FIG. 5*b* is a cross-sectional view of the velocity bypass sub of the straddle packer shown in FIG. 5*a*, with the velocity bypass valve of the velocity bypass sub in a closed condition.

FIG. 4 is a cross-sectional view of the embodiment of the straddle packer 10 shown in FIG. 1 in the packer set condition. All of the components of the straddle packer 10 have been explained with reference to FIGS. 1-3, with the exception of some of the parts of the velocity bypass sub 82, which will be explained below with reference to FIGS. 5*a* and 5*b*, and that explanation of those parts will not be repeated, except insofar as is necessary to describe the functioning of the straddle packer 10.

As explained above, when high pressure fluid is pumped into the straddle packer 10, it exits through the mandrel flow sub nozzle(s) 32*a*-32*h* and, if the optional velocity bypass sub 82 is present, the velocity bypass valve jet nozzle 92 and velocity bypass valve ports 88*a*, 88*b* of the open velocity bypass valve 84 (see FIG. 2) until the pump rate exceeds a threshold pump rate predetermined by an orifice size of the velocity bypass valve jet nozzle 92. In one embodiment, the threshold pump rate is, for example, about 3 bbl/minute. When the threshold pump rate is exceeded, the velocity bypass valve 84 is forced close, as shown in this view, and fluid flow through velocity bypass valve ports 88*a*, 88*b* ceases. When fluid flow through the velocity bypass sub 82 ceases, fluid pressure rapidly builds within the central passage 13 of the multicomponent mandrel 11 because the rate of discharge from the central passage 13 is throttled by the mandrel flow sub nozzle(s) 32*a*-32*h*. Consequently, the high pressure fluid is forced through the active mandrel tube fluid ports 49*a*-49*h* and flows through the pressure cylinder fluid ports 57*a*-57*h* of the respective pressure cylinder modules 54*a*-54*d* and into the respective pressure cylinder chambers 59*a*-59*d*. As explained above with reference to FIG. 2, in one embodiment the pressure pistons 56*a*-56*d* are connected to the lower compression bell 64, and the pressure cylinder walls 55*a*-55*d* are connected to the interconnected sliding sleeves (lower sliding sleeve 36, slotted sliding sleeve 28 and upper sliding sleeve 24), which are in turn connected to the upper compression bell 20. The high pressure fluid forced into the respective pressure cylinder chambers 59*a*-59*d* simultaneously urges the pressure pistons 56*a*-56*d* and the pressure cylinder walls 55*a*-55*d* in opposite directions along an axis of the active mandrel tube component 46. Since the opposite ends of the straddle packer 10 are immovably connected to the multicomponent mandrel 11, the upper compression bell 20 is urged to slide over the upper packer element sleeve 16 by the movement of the pressure cylinder walls 55*a*-55*d*, and the lower compression bell 64 is urged to slide over the lower packer element mandrel sleeve component 72 by the movement of the pressure pistons 56*a*-56*d*. The upper compression bell 20 compresses the upper packer element 18 and the lower compression bell 64 compresses the lower packer element 74 into respective sealing contact with a wellbore. As the upper compression bell 20 slides over the upper packer element sleeve 16, pressure within the upper compression bell 20 is equalized by fluid passing through upper compression bell pressure equalization ports 21*a*, 21*b*. Likewise, as the lower compression bell 64 slides over the lower packer element, mandrel sleeve component 72, pressure within the lower compression bell 64 is equalized by fluid passing through lower compression bell pressure equalization ports 65*a*, 65*b*. In one embodiment the pressure equalization ports 21*a*, 21*b* and 65*a*, 65*b* are all provided with particulate filters (not shown) to inhibit the migration of solids into the respective upper compression bell 20 and the lower compression bell 64. As understood by those skilled in the art, the higher the fluid pressure of the high pressure fluid, the greater the compression of the upper packer element 18 and the lower packer element 74.

After the pumping of the high pressure fluid is completed and pumping stops, the high pressure fluid may or may not continue to flow through the mandrel flow sub nozzle(s) 32*a*-32*h*. If the optional velocity bypass sub 82 is present, once the rate of flow of the high pressure fluid drops below the predetermined threshold, the velocity bypass valve 84 opens and fluid rapidly drains from the central passage 13, which drains the respective pressure cylinder chambers 59*a*-59*d*. As the pressure cylinder chambers 59*a*-59*d* are drained, the upper packer element 18 and the lower packer element 74 return to the relaxed condition, which urges the pressure cylinder walls 55*a*-55*d* and the pressure pistons 56*a*-56*d* back to the run-in condition seen in FIG. 2. The straddle packer 10 can then be moved to another location in the wellbore or removed from the well.

FIG. 5*a* is a cross-sectional view of the velocity bypass sub 82 of the straddle packer 10 shown in FIGS. 1, 2, with the velocity bypass valve 84 in the open, run-in condition. In order to permit assembly and servicing of the velocity bypass valve 84, the velocity bypass sub 82 is constructed in two parts, a velocity bypass sub connector end 85*a* that threadedly connects to the lower crossover sub male connector 80 of the lower crossover sub 76; and, a velocity bypass sub valve end 85*b* that threadedly connects to the velocity bypass sub connector end 85*a*. Cap screws 94*a*, 94*b* inhibit rotation of the velocity bypass sub valve end 85*b* with respect to the velocity bypass sub connector end 85*a*. A velocity bypass valve spring 90 constantly urges the velocity bypass valve 84 to the open condition. A high pressure seal 86 inhibits fluid migration around the velocity bypass valve 84. As explained above, in the open position high pressure fluid flows through a replaceable velocity bypass valve jet nozzle 92 and out through the open velocity bypass valve ports 88*a*, 88*b*. A nozzle size of the velocity bypass valve jet nozzle 92 determines a threshold rate of flow required to overcome the resilience of the velocity bypass valve spring 90 to force the velocity bypass valve 84 to the closed condition shown in FIG. 5*b*.

FIG. 5*b* is a cross-sectional view of the velocity bypass sub 82 of the straddle packer 10 shown in FIG. 4, when the straddle packer 10 is in the set condition or in transition to or from the set condition. As can be seen, the velocity bypass valve 84 has been urged, by a rate of high pressure fluid flow that exceeds the threshold determined by the velocity bypass jet nozzle 92, to the closed condition in which high pressure fluid no longer flows through the velocity bypass valve ports 88*a*-88*b*. In this condition of the velocity bypass valve 84, the high pressure fluid sets the upper packer element 18 and the lower packer element 74, as explained above in detail.

The explicit embodiments of the invention described above have been presented by way of example only. The scope of the invention is therefore intended to be limited solely by the scope of the appended claims.

I claim:

1. A modular pressure cylinder for a downhole tool, comprising:

an active mandrel tube having a central passage and axially spaced-apart groups of active mandrel tube fluid ports; and interconnected modular pressure pistons adapted to slide on the active mandrel tube, each having pressure cylinder fluid ports in fluid communication with corresponding ones of a group of the active mandrel tube fluid ports, the interconnected modular pressure pistons being surrounded by interconnected modular pressure cylinder walls, each modular pressure cylinder wall defining a pressure cylinder on a first side of a corresponding modular pressure piston and having pressure cylinder pressure equalization ports on the opposite side of the corresponding pressure piston, the pressure cylinder fluid ports permitting fluid flow from the central passage through the active mandrel tube fluid ports to enter the pressure cylinders and simultaneously urge the interconnected modular pressure pistons to slide in a first direction on the active mandrel tube and the interconnected pressure cylinder walls to slide in a direction opposite the first direction on the interconnected pressure pistons to convert pumped fluid pressure into a bi-directional mechanical force in the downhole tool.

2. The modular pressure cylinder as claimed in claim 1 wherein the active mandrel tube further comprises an active mandrel tube axial groove in an outer periphery of the active mandrel tube, the active mandrel tube axial grooves being adapted to provide fluid communication between each active mandrel tube fluid port and a corresponding pressure cylinder fluid port as the interconnected modular pressure pistons slide in the first direction on the active mandrel tube.

3. The modular pressure cylinder as claimed in claim 1 wherein each modular pressure piston has a pressure cylinder male coupling sleeve and a pressure cylinder female coupling sleeve, and the respective pressure cylinder male coupling sleeves have an external thread adapted to engage an internal thread in the respective pressure cylinder female coupling sleeves to interconnect the respective interconnected modular pressure pistons.

4. The modular pressure cylinder as claimed in claim 1 further comprising a sleeve/cylinder crossover threadedly connected to a one of the modular pressure cylinder walls at an uphole end of the modular pressure cylinder.

5. The modular pressure cylinder as claimed in claim 1 further comprising a mandrel tube crossover component connected to an uphole end of the active mandrel tube.

6. The modular pressure cylinder as claimed in claim 1 further comprising a pressure cylinder crossover sleeve threadedly connected to a pressure cylinder female coupling sleeve of a one of the modular pressure pistons at an uphole end of the modular pressure cylinder.

7. A modular pressure cylinder for a downhole tool, comprising:

an active mandrel tube having a central passage and axially spaced-apart groups of active mandrel tube fluid ports, each group of active mandrel tube fluid ports providing fluid communication between the central passage and a pressure piston chamber of the modular pressure cylinder; and at least two interconnected modular pressure pistons surrounded by interconnected modular pressure cylinder walls, the interconnected modular pressure pistons being adapted to reciprocate on the active mandrel tube within the pressure cylinders defined by the interconnected modular pressure cylinder walls, the modular pressure pistons having pressure cylinder fluid ports adapted to permit pressurized fluid flowing through corresponding active mandrel tube fluid ports to flow into the respective pressure cylinders to urge the interconnected modular pressure pistons and the interconnected modular pressure cylinder walls to simultaneously slide in opposite directions along an axis of the active mandrel tube; and pressure cylinder pressure equalization ports in each interconnected modular pressure cylinder wall.

8. The modular pressure cylinder as claimed in claim 7 wherein the active mandrel tube further comprises an active mandrel tube axial groove associated with each active mandrel tube fluid port in an outer periphery thereof, each active mandrel tube axial groove being in fluid communication with one of the active mandrel tube fluid ports to provide fluid communication between the central passage of the active mandrel tube and the corresponding pressure cylinder fluid port while the interconnected modular pressure cylinders are urged along the axis of the active mandrel tube.

9. A modular pressure cylinder for a downhole tool, comprising:

an active mandrel tube having a central passage and axially spaced-apart groups of active mandrel tube fluid ports, each active mandrel tube fluid port providing fluid communication between the central passage and a corresponding active mandrel tube axial groove in an outer periphery of the active mandrel tube to provide fluid communication between the central passage and a corresponding pressure cylinder fluid port in a modular pressure piston of the modular pressure cylinder while the modular pressure piston is urged to slide along an axis of the active mandrel tube; and each modular pressure piston having a pressure cylinder male coupling sleeve and a pressure cylinder female coupling sleeve to interconnect the respective modular pressure pistons, each modular pressure piston further having a pressure piston seal that provides a fluid seal against a corresponding modular pressure cylinder wall of the modular pressure cylinder, the interconnected modular pressure pistons reciprocating within pressure cylinders defined by the interconnected modular pressure cylinder walls and the interconnected modular pressure pistons, the interconnected modular pressure cylinder walls respectively including pressure cylinder pressure equalization ports to equalize fluid pressure behind the respective pressure piston seals when the interconnected modular pressure pistons are urged by pumped fluid pressure to slide in one direction over the active mandrel tube and the interconnected modular pressure cylinder walls are urged by the pumped fluid pressure to slide in an opposite direction over the interconnected modular pressure pistons.

* * * * *